US006071854A

United States Patent [19]

Nakamura et al.

[11] Patent Number: 6,071,854

[45] Date of Patent: Jun. 6, 2000

[54] THERMALLY SENSITIZED SHEET

[75] Inventors: Yoshinori Nakamura; Akihiro Horii; Hiroaki Ogasawara, all of Miyagi, Japan

[73] Assignee: Sony Corporation, Tokyo, Japan

[21] Appl. No.: 09/130,152

[22] Filed: Aug. 6, 1998

[30] Foreign Application Priority Data

Aug. 13, 1997 [JP] Japan ..... 9-218743

[51] Int. Cl.[7] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 5,322,832 6/1994 Takeyama et al. ..... 503/227

FOREIGN PATENT DOCUMENTS 0348989 6/1989 European Pat. Off. ..... 503/227

*Primary Examiner*—Bruce H. Hess

*Attorney, Agent, or Firm*—Jay H. Maioli

[57] ABSTRACT

A thermally sensitized sheet having excellent light resistance and weather resistance and capable of suppressing deterioration, a decrease clearness and color change of an image formed by a dye transferred to a reception layer. The thermally sensitized sheet includes a substrate 1 on which a dye reception layer 2 is formed. The dye reception layer 2 contains a compound expressed by:

wherein R1, R2, and R3 represent alkyl groups.

7 Claims, 1 Drawing Sheet

THERMALLY SENSITIZED SHEET

BACKGROUND OF THE INVENTION

1. Field of the Invention

The present invention relates to a thermal transfer sheet to which a dye is transferred from an ink ribbon or the like according to a heat amount applied.

2. Description of the Prior Art

As a method for developing on a sensitized paper an image information entered into a video apparatus, there is a known method using a subliming dye or a thermal-melting dye.

In this thermal transfer method, a thermal transfer sheet (ink ribbon) having a dye layer formed is placed on a thermally sensitized sheet having a reception layer for receiving the dye so that the dye layer is opposed to the reception layer, and a thermal head or the like is used to apply a heat in dot shapes according to an image signal. Thus, the dye in the dye layer sublimes or is melted to move to the reception layer of the sensitized paper and image appears on the sensitized paper.

However, the conventional thermally sensitized sheet has a problem that the image formed does not have a sufficient light resistance or weather resistance. That is, the image formed becomes unclear or discolored. The reason is considered to be as follows: the dye which is transferred by a thermal head or the like is located in the vicinity of the surface of the reception layer and easily affected by humidity and oxygen in the air.

SUMMARY OF THE INVENTION

It is therefore an object of the preset invention to provide a thermally sensitized sheet having an excellent light resistance and weather resistance, suppressing the deterioration of the image formed by a dye which has been transferred to a reception layer.

The inventor of the present invention has studied various cases so as to achieve aforementioned object and found that when a reception layer contains a trimellitic acid ester compound, the dye which has been transferred to the reception layer has a significantly enhanced weather resistance and light resistance.

That is, the thermally sensitized sheet according to the present invention is a thermally sensitized sheet including a substrate having a dye reception layer formed on the substrate, the dye reception layer containing a compound expressed by Chemical Formula 2 as follows.

[Chemical Formula 2]

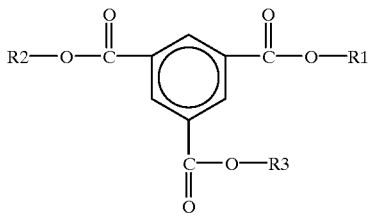

wherein R1, R2, and R3 represent alkyl groups.

The thermally sensitized sheet of the aforementioned configuration has a dye reception layer containing a trimellitic acid ester compound and as a result, an image formed by a dye transferred to the dye reception layer has a significantly improved light resistance and weather resistance, although no detail is known about the mechanism of improvement of the light resistance and weather resistance by the trimellitic acid ester compound.

DETAILED DESCRIPTION OF THE PREFERRED EMBODIMENTS

Figure 1:
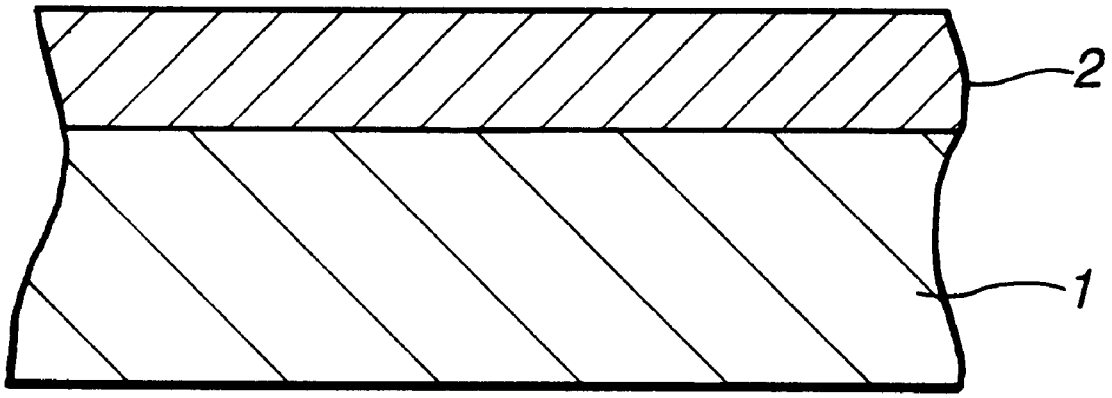
FIG. 1 is a cross sectional view of a thermally sensitized sheet according to the present invention.

Hereinafter, description will be directed to a thermally sensitized sheet according to preferred embodiments of the present invention.

FIG. 1 shows an example of the thermally sensitized sheet according to the present invention. This thermally sensitized sheet is used as a so-called printing sheet in combination with a thermal transfer sheet such as an ink ribbon having a dye layer containing a dye so that a dye which has been transferred from the thermal transfer sheet forms a predetermined image.

This thermally sensitized includes a sheet-shaped substrate 1 and a dye reception layer 2 formed on the substrate 1 for receiving a dye. On this thermally sensitized sheet, according to a video signal for example, a predetermined heat amount is selectively applied by the thermal head so that a dye is transferred from the thermal transfer sheet to the reception layer 2, forming an image.

The substrate 1 of this thermally sensitized sheet may be made from a conventionally used material such as a high quality paper, coat paper, various types of plastic sheets, or a composite sheet made from combination of these materials.

Moreover, the dye reception layer 2 of this thermally sensitized sheet contains as main components a resin and a compound expressed by a Chemical Formula as follows.

[Chemical Formula 3]

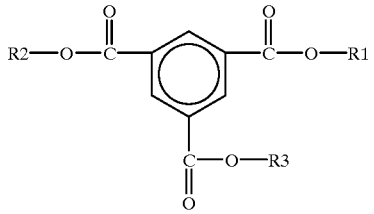

wherein R1, R2, and R3 represent alkyl groups.

In the trimellitic acid ester compound expressed in Chemical Formula given above, the alkyl groups R1, R2, and R3 preferably have 4 to 14 carbons.

In the trimellitic acid ester compound, if the number of carbons in the alkyl group is 3 or less, the dye transferred to the dye reception layer 2 may not have sufficiently improved light resistance. Moreover, if the number of carbons is 15 or above, the dye transferred to the dye reception layer 2 may ooze out. Accordingly, when the number of carbons in the alkyl groups is 4 to 14, it is possible to assure improvement of the light resistance of the dye transferred to the dye reception layer 2 and to prevent oozing out of the dye transferred to the dye reception layer 2.

Moreover, in the trimellitic acid ester compound expressed by the aforementioned Chemical Formula, it is preferable that at least one of the alkyl groups expressed by R1, R2, and R3 have a different number of carbons. In other words, it is preferable that the alkyl groups expressed by R1, R2, and R2 do not have an identical structure.

In the trimellitic acid ester compound, if the alkyl group R1, the alkyl group R2, and the alkyl group R3 are identical compounds, there is a danger that the dye transferred to the dye reception layer 2 has a deteriorated light resistance. Accordingly, if at least one of the alkyl group R1, the alkyl group R2, and the alkyl group R3 has a different number of carbons, it is possible to surely improve the light resistance of the dye transferred to the dye reception layer 2.

Furthermore, it is preferable that 4 to 40 weight parts of the trimellitic acid ester compound expressed by the aforementioned Chemical Formula be added with respect to 100 weight parts to resin. If the quantity of the trimellitic acid ester compound added is less than 4 weight parts, there is a danger that the light resistance may deteriorated. Moreover, if the quantity of the trimellitic acid ester compound added exceeds 40 weight parts, the dye transferred may ooze out. Accordingly, when the quantity of the trimellitic acid ester compound added is in the range of 4 to 40 weight parts, a clear image can be formed on the thermally sensitized sheet with an excellent light resistance and without oozing out of the dye transferred.

As the resin constituting the dye reception layer 2, it is possible to use those materials which have been used conventionally. There can be exemplified a thermoplastic resin, heat-setting vest, UV (ultraviolet) setting resin, and the like. More specifically, there can be exemplified, polyester resin, polycarbonate resin, polyvinyl acetate resin, polycoude resin, polyvinyl chloride resin, polystyrene resin, styrene acrylate resin, polyurethane resin, urea resin, or copolymers of these resins.

Moreover, in this thermally sensitized sheet, it is possible to add a fluorescent whitening agent and a white pigment for the purpose of increasing the whiteness of the dye reception layer 2, increasing the clearness of an image transferred, and facilitating writing on the surface of the thermally sensitized sheet as well as preventing re-transfer of the transferred image. As the white pigment, it is possible to use, for example, titanium oxide, calcium carbonate, or zinc oxide. As the fluorescent whitening agent, it is possible to use, for example, any of the fluorescent whitening agents on the market such as Yubitex OB (trade name) produced by Chibagaiki Co., Ltd.

Furthermore, the dye reception layer 2 may contain an agent for increasing separation from a thermal transfer sheet during a thermal transfer. This agent promoting separation may be polyethylene wax, amide wax, Teflon powder, and other solid waxes; fluorine surface active agent and phosphate ester surface active agent; silicone oil, high-melting-point silicone wax, and the like. More specifically, the silicone oil may be methylstylene denatured silicone oil (trade name: KF410 produced by Shin'etsu Kagaku Co., Ltd.), olefin denatured silicone oil (trade name: KF414 produced by Shin'etsu Kagaku Co., Ltd.). polyether denatured silicone oil (trade name: KF355 produced by Shin'etsu Kagaku Co. Ltd.), fluorine denatured silicone oil (trade name: X-22-819 produced by Shin'etsu Kagaku Co., Ltd.), epoxy denatured silicone oil (trade name: KF103 produced by Shin'etsu Kagaku Co., Ltd.), carboxy denatured silicone oil (trade name: X-22-3710 produced by Shin'etsu Kgaku Co., Ltd.), amino denatured silicone oil (trade name: KF393 produced by Shin'etsu Kgau Co., Ltd.). Moreover, as the agent for promoting separation, there can be exemplified Dye-free produced by Dyekin Kogyo co., Ltd.

Furthermore, it is possible to apply an anti-charge agent to the dye reception layer 2 internally or externally so as to prevent electrostatic generation during a sheet feeding.

As the anti-charge agent, for example, a surface active agent is used. As the surface active agent, it is possible to use any of anion type surface active agent, cation type surface active agent, ampho-ion type surface active agent, and non-ion type surface active agent. The anion type surface active agent may be quaternary ammonium salt, polyamine derivative, and the like. As the cation type surface active agent. The cation type surface active agent may be alkyl benzen sulphonate, alkyl sulphonate ster sodium salt, and the like.

Moreover, in the dye reception layer 2, it is possible to apply a ultraviolet (UV) ray absorbing agent and an anti-oxidation agent. It is should be noted that the dye reception layer 2 may also contain a plastic or the like.

As the UV absorbing agent, there can be exemplified SEESORB 100 and SEESORB 102 and the like produced by Sypro Chemicals Co., Ltd. as a benzophenone agent; SEESORB 501 and the like produced by Sypro Chemicals Co., Ltd. as diphenyl acrylate agent; and SEESORB 701 and the like produced by Sypro Chemicals Co. Ltd. as a benzotriazol agent. Moreover, as the anti-oxidation agent, there can be exemplified Sumilizer BHT and the like produced by Sumitomo Kagaku Co., Ltd as a phenol agent; Sumilizer TPM and the like produced by Sumitomo Kagaku Co., Ltd. as an organic sulfur agent; and Sumilizer TNP and the like produced by Sumitomo Kagaku Co., Ltd. as a phosphate agent.

The thermally sensitized sheet having the aforementioned configuration according to the present invention includes the dye reception layer 2 containing the trimellitic acid ester compound expressed by the aforementioned Chemical Formula and enables to increase the weather resistance and the light resistance of the dye reception layer 2. Thus, in this thermally sensitized sheet, an image formed by a dye transferred from a thermal transfer sheet can be maintained clear for a long period of time. Moreover, in this thermally sensitized sheet having the dye reception layer 2 containing the trimellitic acid ester compound, the dye transferred will not ooze out. Thus, on this thermally sensitized sheet, it is possible to form a clear image without oozing out of the dye which has been transferred from a thermal transfer sheet.

EXAMPLES

As examples, thermally sensitized sheets were actually prepared according to the present invention and their light resistance and ooze-out characteristic were evaluated. For comparison to these examples, other thermally sensitized sheets were prepared as comparative examples and their light resistance and ooze-out characteristic were evaluated.

In the Examples given below, the alkyl group R1, alkyl group R2, and alkyl group R3 used were trimellitic acid ester compounds (expressed as additives in Table 1) having structures as shown in Table 1.

TABLE 1

| | R1 | R2 | R3 |
|---|---|---|---|
| Additive A | $-C_4H_9$ | $-C_4H_9$ | $-C_8H_{17}$ |
| Additive B | $-C_4H_9$ | $-C_8H_{17}$ | $-C_8H_{17}$ |
| Additive C | $-C_8H_{17}$ | $-C_8H_{17}$ | $-C_{10}H_{21}$ |
| Additive D | $-C_9H_{19}$ | $-C_9H_{19}$ | $-C_{10}H_{21}$ |
| Additive E | $-C_4H_9$ | $-C_8H_{17}$ | $-C_9H_{19}$ |
| Additive F | $-C_4H_9$ | $-C_9H_{19}$ | $-C_{10}H_{21}$ |
| Additive G | $-C_8H_{17}$ | $-C_9H_{19}$ | $-C_{10}H_{21}$ |
| Additive H | $-C_9H_{19}$ | $-C_9H_{19}$ | $-C_9H_{19}$ |
| Additive I | $-C_8H_{17}$ | $-C_8H_{17}$ | $-C_8H_{17}$ |
| Additive J | $-C_{10}H_{21}$ | $-C_{10}H_{21}$ | $-C_{10}H_{21}$ |
| Additive K | $-C_3H_7$ | $-C_3H_7$ | $-C_3H_7$ |
| Additive L | $-C_4H_9$ | $-C_4H_9$ | $-C_4H_9$ |
| Additive M | $-C_4H_9$ | $-C_4H_9$ | $-C_3H_7$ |

TABLE 1-continued

| | R1 | R2 | R3 |
|---|---|---|---|
| Additive N | $-C_4H_9$ | $-C_3H_7$ | $-C_3H_7$ |
| Additive O | $-C_9H_{19}$ | $-C_9H_{19}$ | $-C_{12}H_{15}$ |
| Additive P | $-C_{14}H_{29}$ | $-C_{14}H_{29}$ | $-C_{14}H_{29}$ |
| Additive Q | $-C_{14}H_{29}$ | $-C_8H_{17}$ | $-C_{14}H_{29}$ |
| Additive R | $-C_{15}H_{31}$ | $-C_{15}H_{31}$ | $-C_{16}H_{33}$ |
| Additive S | $-C_{16}H_{33}$ | $-C_{16}H_{33}$ | $-C_{16}H_{33}$ |

Example 1

Firstly, as the substrate 1, a synthetic paper (trade name: YUPO EPG-150 produced by Oji Yuka Co., Ltd.) having a thickness of 150 $\mu$m was prepared, to which a reception layer paint was applied by using a gravure coater with a dried film thickness of 10 $\mu$m. The paint was cured at temperature of 120° C. for 2 minutes, thus forming the dye reception layer 2. Note that the reception layer paint had a composition as follows.

| <Reception layer paint composition> | |
|---|---|
| Resin | 100 weight parts |
| Trimellitic acid ester compound A | 40 weight parts |
| Separation agent | 3 weight parts |
| Anti-charge agent | 5 weight parts |
| Methyl ethyl ketone | 200 weight parts |
| Toluene | 200 weight parts |

The resin used in the aforementioned reception layer paint was cellulose acetate butyrate (trade name: CAB 381-1 produced by Eastman Chemical Co., Ltd.). The separation agent used was amino denatured silicone (trade name: KF 393 produced by Shin'etsu Kagaku Co. Ltd.). The anti-charge agent used was isocyanate compound (trade name: Coronate L produced by Nihon Polyurethane Co. Ltd.). These ingredients were mixed and kneaded for sufficient dispersion so as to prepare the reception layer paint.

Example 2 to 35

Examples 2 to 35 of the thermally sensitized sheet were prepared in the same way as the aforementioned Example 1 except for the reception layer paint had compositions as shown in Tables 2 and 3.

TABLE 2

| | CAB381-1 | Bylon 20 | #1000AKT | Additive |
|---|---|---|---|---|
| Example 1 | 100 | | | Additive A 40 |
| Example 2 | 100 | | | Additive A 20 |
| Example 3 | 100 | | | Additive A 10 |
| Example 4 | 100 | | | Additive A 5 |
| Example 5 | 100 | | | Additive A 4 |
| Example 6 | 100 | | | Additive A 2 |
| Example 7 | 100 | | | Additive B 5 |
| Example 8 | 100 | | | Additive B 10 |
| Example 9 | 100 | | | Additive B 20 |
| Example 10 | 100 | | | Additive B 40 |
| Example 11 | 100 | | | Additive C 20 |
| Example 12 | 100 | | | Additive D 20 |
| Example 13 | 100 | | | Additive E 20 |
| Example 14 | 100 | | | Additive F 20 |
| Example 15 | 100 | | | Additive G 20 |

TABLE 2-continued

| | | | | |
|---|---|---|---|---|
| Example 16 | | 100 | | Additive A 1 |
| Example 17 | | 100 | | Additive A 5 |
| | KF393 | Coronate L | MEK | Toluene |
| Example 1 | 3 | 5 | 200 | 200 |
| Example 2 | 3 | 5 | 200 | 200 |
| Example 3 | 3 | 5 | 200 | 200 |
| Example 4 | 3 | 5 | 200 | 200 |
| Example 5 | 3 | 5 | 200 | 200 |
| Example 6 | 3 | 5 | 200 | 200 |
| Example 7 | 3 | 5 | 200 | 200 |
| Example 8 | 3 | 5 | 200 | 200 |
| Example 9 | 3 | 5 | 200 | 200 |
| Example 10 | 3 | 5 | 200 | 200 |
| Example 11 | 3 | 5 | 200 | 200 |
| Example 12 | 3 | 5 | 200 | 200 |
| Example 13 | 3 | 5 | 200 | 200 |
| Example 14 | 3 | 5 | 200 | 200 |
| Example 15 | 3 | 5 | 200 | 200 |
| Example 16 | 3 | 5 | 200 | 200 |
| Example 17 | 3 | 5 | 200 | 200 |

TABLE 3

| | CAB381-1 | Bylon 20 | #1000AKT | Additive |
|---|---|---|---|---|
| Example 18 | | 100 | | Additive A 20 |
| Example 19 | | | 100 | Additive D 1 |
| Example 20 | | | 100 | Additive D 5 |
| Example 21 | | | 100 | Additive D 20 |
| Example 22 | 100 | | | Additive H 20 |
| Example 23 | 100 | | | Additive I 20 |
| Example 24 | 100 | | | Additive J 20 |
| Example 25 | 100 | | | Additive K 20 |
| Example 26 | 100 | | | Additive L 20 |
| Example 27 | 100 | | | Additive M 20 |
| Example 28 | 100 | | | Additive N 20 |
| Example 29 | | 100 | | Additive L 20 |
| Example 30 | | 100 | | Additive M 20 |
| Example 31 | 100 | | | Additive O 20 |
| Example 32 | 100 | | | Additive P 20 |
| Example 33 | 100 | | | Additive Q 20 |
| Example 34 | 100 | | | Additive R 20 |
| Example 35 | 100 | | | Additive S 20 |
| | KF393 | Coronate L | MEK | Toluene |
| Example 18 | 3 | 5 | 200 | 200 |
| Example 19 | 3 | 5 | 200 | 200 |
| Example 20 | 3 | 5 | 200 | 200 |
| Example 21 | 3 | 5 | 200 | 200 |
| Example 22 | 3 | 5 | 200 | 200 |
| Example 23 | 3 | 5 | 200 | 200 |
| Example 24 | 3 | 5 | 200 | 200 |
| Example 25 | 3 | 5 | 200 | 200 |
| Example 26 | 3 | 5 | 200 | 200 |
| Example 27 | 3 | 5 | 200 | 200 |
| Example 28 | 3 | 5 | 200 | 200 |
| Example 29 | 3 | 5 | 200 | 200 |
| Example 30 | 3 | 5 | 200 | 200 |
| Example 31 | 3 | 5 | 200 | 200 |
| Example 32 | 3 | 5 | 200 | 200 |
| Example 33 | 3 | 5 | 200 | 200 |
| Example 34 | 3 | 5 | 200 | 200 |
| Example 35 | 3 | 5 | 200 | 200 |

It should be noted that in Tables 2 and 3, the Bylon 20 (trade name) used as a resin is a polyester resin produced by Toyobo Co., Ltd. Moreover, the #1000 AKT (trade name) used as a resin is a vinyl chloride—vinyl acetate copolymer produced by Denki Kagaku Co., Ltd. Furthermore, the methylethyl ketone used as a solvent is expressed as MEK in Tables 2 and 3.

Comparative Examples 1 to 14

Comparative Examples 1 to 14 of the thermally sensitized sheet were prepared in the same way as the aforementioned Example 1 except for that the reception layer paints used had the compositions shown in Table 4. That is, in the Comparative Examples of the thermally sensitized sheets, the dye reception layer contained, instead of the trimellitic acid ester compound, phthalic acid ester which has been conventionally used for increasing the light resistance.

It should be noted that in this Table 4, the phthalic acid esters actually used were dioctyl phthalate (expressed as DOP), dibutyl phthalate (expressed as DBP), diisononyl phthalate (expressed as DINP), diisodecyl phthalate (expressed as DIDP), ad dioctyl agipate (expressed DOA).

TABLE 4

| | CAB381-1 | Bylon 20 | #1000 AKT | DOP | DBP | DINP |
|---|---|---|---|---|---|---|
| Comparative Example 1 | 100 | | | 20 | | |
| Comparative Example 2 | 100 | | | | 20 | |
| Comparative Example 3 | 100 | | | | | 20 |
| Comparative Example 4 | 100 | | | | | |
| Comparative Example 5 | 100 | | | | | |
| Comparative Example 6 | 100 | | | 40 | | |
| Comparative Example 7 | 100 | | | | | |
| Comparative Example 8 | | 100 | | 20 | | |
| Comparative Example 9 | | 100 | | | | |
| Comparative Example 10 | | | 100 | 20 | | |
| Comparative Example 11 | | | 100 | | | |
| Comparative Example 12 | 100 | | | | | |
| Comparative Example 13 | | 100 | | | | |
| Comparative Example 14 | | | 100 | | | |

| | DIDP | DOA | KF393 | Coronate L | MEK | Toluene |
|---|---|---|---|---|---|---|
| Comparative Example 1 | | | 3 | 5 | 200 | 200 |
| Comparative Example 2 | | | 3 | 5 | 200 | 200 |
| Comparative Example 3 | | | 3 | 5 | 200 | 200 |
| Comparative Example 4 | 20 | | 3 | 5 | 200 | 200 |
| Comparative Example 5 | | 20 | 3 | 5 | 200 | 200 |
| Comparative Example 6 | | | 3 | 5 | 200 | 200 |
| Comparative Example 7 | | 40 | 3 | 5 | 200 | 200 |
| Comparative Example 8 | | | 3 | 5 | 200 | 200 |
| Comparative Example 9 | | 20 | 3 | 5 | 200 | 200 |
| Comparative Example 10 | | | 3 | 5 | 200 | 200 |
| Comparative Example 11 | | 20 | 3 | 5 | 200 | 200 |
| Comparative Example 12 | | | 3 | 5 | 200 | 200 |
| Comparative Example 13 | | | 3 | 5 | 200 | 200 |
| Comparative Example 14 | | | 3 | 5 | 200 | 200 |

Characteristic Evaluation Test

By using the Examples and Comparative Examples prepared as described above, the light resistance and oozing-out were evaluated as follows. Here, the aforementioned Examples of thermally sensitized sheets and Comparative Examples of thermally sensitized sheet were tested through gradation printing by using a thermal transfer printer (trade name: UP-1200 produced by Sony Co., Ltd.) with an ink ribbon (trade name: UPC-1010 produced by Sony Co., Ltd.) having pigments of Yellow (Y), Magenta (M), and Cyan (C). The thermally sensitized sheets on which the gradation printing was carried out were subjected to the characteristic evaluation test as follows.

<Light Resistance Evaluation>

For the light resistance evaluation, firstly, light of 9000 $KJ/m^2$ was applied to the thermally sensitized sheets by using a Xenon Weather-meter (produced by Suga Shikenki Co., Ltd.). After this, a Macbeth concentration-meter (trade name: TR-924 produced by Macbeth Co., Ltd.) was used to determine an optical concentration of gradation step in the vicinity of black concentration of 1.0 of the thermally sensitized sheets.

The following equation was used to calculate a dye residual ratio as a light resistance index.

$$\text{Dye residual ratio (\%)} = (\text{Reflection concentration after light radiation})/(\text{Reflection concentration before light radiation}) \quad (1)$$

Accordingly, as the dye residual ratio calculated by this Equation (1) becomes greater, the sheet has more excellent light resistance. ps <Oozing-out evaluation>

For oozing-out evaluation, firstly, a predetermined image was formed on the thermally sensitized sheets as has been described above. After this, the thermally sensitized sheets were kept in an environment of relative humidity 85%, temperature 65° C. for 2 weeks. Then, the image formed on the thermally sensitized sheets were checked by visual observation to evaluate the oozing-out.

Here, a completely clear image without any oozing out is indicated by ○; a preferable image with some oozing out is indicated by Δ; and an image dimmed by oozing out is indicated by X.

Tables 5 to 7 show results of the light resistance evaluation test and the oozing-out evaluation test.

TABLE 5

| | Light Resistance | Oozing |
|---|---|---|
| Example 1 | 89 | ○ |
| Example 2 | 85 | ○ |
| Example 3 | 84 | ○ |
| Example 4 | 83 | ○ |
| Example 5 | 81 | ○ |
| Example 6 | 80 | ○ |
| Example 7 | 80 | ○ |
| Example 8 | 85 | ○ |
| Example 9 | 88 | ○ |
| Example 10 | 88 | ○ |
| Example 11 | 92 | ○ |

TABLE 5-continued

| | Light Resistance | Oozing |
|---|---|---|
| Example 12 | 95 | ○ |
| Example 13 | 94 | ○ |
| Example 14 | 94 | ○ |
| Example 15 | 93 | ○ |
| Example 16 | 75 | ○ |
| Example 17 | 80 | ○ |

TABLE 6

| | Light Resistance | Oozing |
|---|---|---|
| Example 18 | 82 | ○ |
| Example 19 | 88 | ○ |
| Example 20 | 91 | ○ |
| Example 21 | 95 | ○ |
| Example 22 | 82 | ○ |
| Example 23 | 80 | Δ |
| Example 24 | 83 | Δ |
| Example 25 | 83 | Δ |
| Example 26 | 81 | ○ |
| Example 27 | 83 | Δ |
| Example 28 | 81 | Δ |
| Example 29 | 72 | ○ |
| Example 30 | 83 | Δ |
| Example 31 | 88 | ○ |
| Example 32 | 88 | ○ |
| Example 33 | 89 | Δ |
| Example 34 | 89 | Δ |
| Example 35 | 88 | Δ |

TABLE 7

| | Light Resistance | Oozing |
|---|---|---|
| Comparative Example 1 | 72 | X |
| Comparative Example 2 | 71 | X |
| Comparative Example 3 | 73 | X |
| Comparative Example 4 | 75 | X |
| Comparative Example 5 | 70 | X |
| Comparative Example 6 | 77 | X |
| Comparative Example 7 | 76 | X |
| Comparative Example 8 | 67 | X |
| Comparative Example 9 | 65 | X |
| Comparative Example 10 | 78 | X |
| Comparative Example 11 | 78 | X |
| Comparative Example 12 | 80 | ○ |
| Comparative Example 13 | 70 | ○ |
| Comparative Example 14 | 85 | ○ |

As is clear from Tables 5 to 7, the Examples of thermally sensitized sheets having the dye reception layer containing the trimellitic acid ester compound exhibited an excellent light resistance with suppressed oozing out in comparison to the Comparative Examples of thermally sensitized sheets. Thus, the Examples of thermally sensitized sheets can maintain in a preferable condition the image formed by dye transferred from a thermal transfer sheet with an excellent light resistance for a long period of time.

Moreover in Tables 5 to 7, if Example 2, Example 18, and Example 21 are compared to one another, it can be understood that the addition of the trimellitic acid ester compound increases the light resistance regardless of the type of resin constituting the dye reception layer 2.

Furthermore, if Examples 1 to 6 are compared to one another, it can be understood that as the content of the trimellitic acid ester compound added increases, the light resistance increases. When the content of the trimellitic acid ester is smaller than 4 weight parts as in Examples 6, 16, and 19, the light resistance is not so preferable. However, if these Examples 6, 16, and 19 are compared to the Comparative Examples 12 to 14, it is clear that the Examples 6, 16, and 19 have an improved light resistance. It should be noted that if the content of the trimellitic acid ester compound exceeds 40 weight parts, there arises a danger of oozing out.

Moreover, Examples 2, 9, 11, and 12 in which only one alkyl group is different from the other alkyl groups can be compared to Examples 13, 14, and 15 in which all the alkyl groups are different from one another, and Examples 22, 23,24, and 25 in which all the alkyl groups are identical. As is clear from the results shown in Tables 5 to 7, this comparison shows that when all the alkyl groups are identical, the light resistance evaluation and oozing out evaluation are not so preferable. However, in this case also, the light resistance evaluation and the oozing out evaluation are better than the results of Comparative Examples 1 to 14.

Furthermore, when Examples 25 to 28 are compared to one another, it can be understood that the oozing out evaluation is not preferable when the trimellitic acid ester compound used has at least one alkyl group containing less than 4 carbons. Similarly, when Examples 31 to 34 are compared to one another, it can be understood that the oozing out evaluation is not so preferable if the trimellitic acid ester compound used has at least one alkyl group having more than 14 carbons.

As has been described above, the thermally sensitized sheet according to the present invention has the dye reception layer 2 containing a trimellitic acid ester compound and accordingly, it is possible to obtain a preferable image without oozing out of the dye transferred and with an excellent light resistance. Here, when the trimellitic acid ester compound has a predetermined number of carbons and alkyl groups having different number of carbons from one another, the thermally sensitized sheet can exhibit a further excellent light resistance and suppression of oozing out.

As has been detailed above, the thermally sensitized sheet according to the present invention has a dye reception layer containing a trimellitic acid ester compound which enables to form a preferable image without oozing of a dye transferred and with an excellent light resistance. Consequently, this thermally sensitized sheet is capable of maintaining a clear image for a long period of time.

What is claimed is:

1. A thermally sensitized sheet having a dye reception layer containing a trimellitic acid ester compound expressed by a Chemical Formula as:

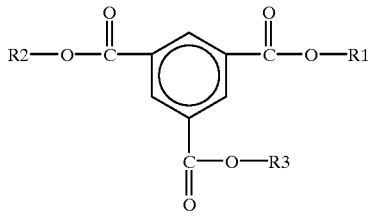

wherein R1, R2, and R3 represent alkyl groups, and wherein said dye reception layer includes a resin and contains 4 to 40 weight parts of said trimellitic acid ester compound with respect to 100 weight parts of said resin.

2. The thermally sensitized sheet as claimed in claim 1, wherein in said compound expressed by said Chemical Formula said alkyl groups R1, R2, and R3 have 4 14 carbons.

3. The thermally sensitized sheet as claimed in claim 1, wherein in said compound expressed by said Chemical Formula, at least one of said alkyl groups R1, R2, R2 has a different number of carbons than the other ones of said alkyl groups.

4. The thermally sensitized sheet as claimed in claim 1, wherein said resin in said dye reception layer is selected from a group consisting of polyester resin, polycarbonate resin, polyvinyl acetate resin, polyamide resin, polyvinyl chloride resin, polystyrene resin, stylene acrylate resin, polyurethane resin, and urea resin.

5. The thermally sensitized sheet as claimed in claim 1, wherein said dye reception layer further contains at least one of a separation agent, and anti-charge agent, an ultraviolet ray absorbing agent, and an anti-oxidization agent.

6. The thermally sensitized sheet as claimed in claim 5, wherein said separation agent is selected from a group consisting of polyethylene wax, amide wax, Teflon powder, fluorine surface active agent, and phosphoric acid ester surface active agent.

7. The thermally sensitized sheet as claimed in claim 5, wherein said anti-charge agent is selected from a group consisting of an anion type surface activevagent, cation type surface active agent, ampho-ion type surface active agent, and non-ion type surface active agent.

* * * * *